United States Patent [19]

Saenz

[11] 4,158,274

[45] Jun. 19, 1979

[54] REMOVABLE MIRRORED WALL COVERING

[76] Inventor: Hector Saenz, 9401 SW. 4 St., Apt. #206, Miami, Fla. 33174

[21] Appl. No.: 863,329

[22] Filed: Dec. 22, 1977

[51] Int. Cl.[2] ..... G02B 5/08; E04B 1/38

[52] U.S. Cl. ..... 52/127; 52/311; 52/385; 52/391; 52/506; 350/292

[58] Field of Search ..... 350/292; 52/127, 311, 52/385, 390, 391, 506, 511, 623, 629, 627, 786, 812, 813

[56] References Cited

U.S. PATENT DOCUMENTS

| | | | |
|---|---|---|---|
| 1,649,842 | 11/1927 | McBride | 52/506 X |
| 1,813,162 | 7/1931 | Hoegger | 52/509 X |
| 2,048,132 | 7/1936 | Madsen | 52/506 X |
| 2,347,176 | 4/1944 | Doner | 52/623 X |
| 2,776,990 | 5/1954 | Bienenfield | 52/127 X |

*Primary Examiner*—Alfred C. Perham

[57] ABSTRACT

A removable wall covering composed of mirror panels each having a backing board covered by a mirrored surface and wherein the panels are adapted to be placed into abutting relation to cover the wall and each of the panels includes a through recess to receive a fastener means and a mirrored piece is cemented over the mouth of the recess to disguise the fastener means and to create a design on the wall.

4 Claims, 2 Drawing Figures

REMOVABLE MIRRORED WALL COVERING

FIELD OF THE INVENTION

This invention relates to wall coverings and, more particularly, to a mirrored wall covering composed of a plurality of interconnected panels.

BACKGROUND OF THE INVENTION

In many apartments persons desire to decorate; however, the range of items which may be installed is limited, because, once installed, some items may not be removed. This is the case with conventional mirrored walls. On the other hand, people in small apartments quite often prefer to cover a wall with a mirror so as to give the illusion of a larger place within which one lives. This invention is of a wall covering which is mirrored which may be installed in covering relation of a wall yet which may be removed when the person moves and taken to a new apartment, and, there installed, with little or slight modification.

OBJECTS OF THE INVENTION

It is, accordingly, an object of this invention to provide a removable wall covering especially useful in apartments and which may be readily installed.

It is a general object of this invention to provide a wall covering composed of a plurality of panels adapted to be placed in abutting relation to one another to cover a wall and wherein each of the panels is composed of a backing board and a congruent mirror piece adhered to a main surface of the panel and wherein a plurality of through recesses are provided at spaced locations to an existing wall in the apartment and wherein strips of mirrored pieces are provided to be cemented over the recesses through the panels to disguise the means for attaching it to the wall and which mirrored pieces may be arranged in a decorative array on the mirrored surface of the mirror panels.

In accordance with these and other general objects, other and more specific objects will become apparent in the light of the following disclosure, accordingly, the instant invention will now be described with reference to the accompanying drawing, in which:

DESCRIPTION OF PREFERRED EMBODIMENT

Figure 1:
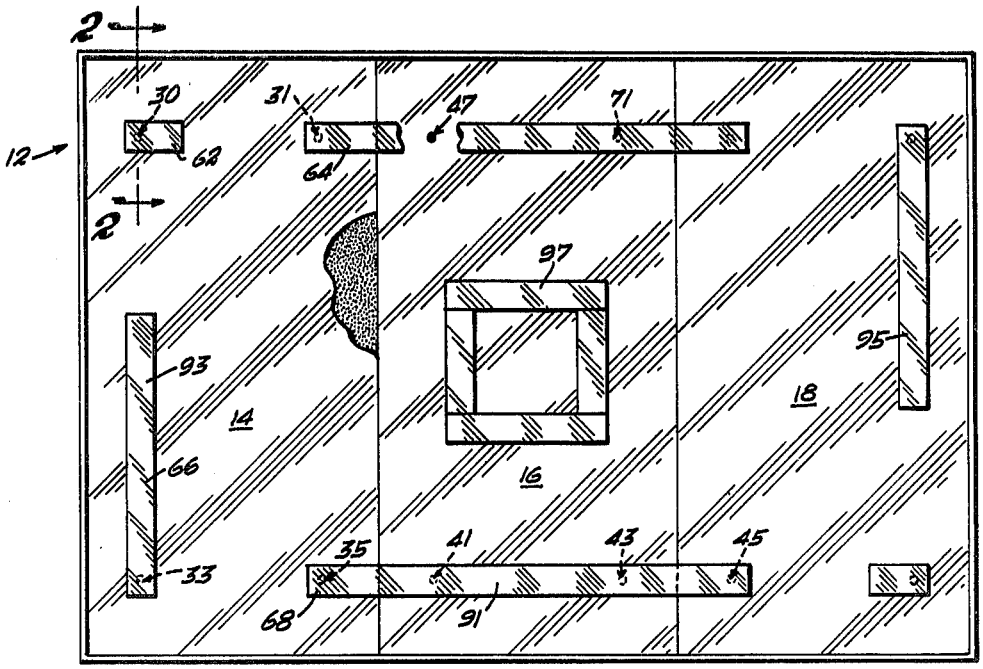
FIG. 1 is a front elevation view of a wall which has been covered with a mirrored wall covering in accordance with this invention.
Figure 2:
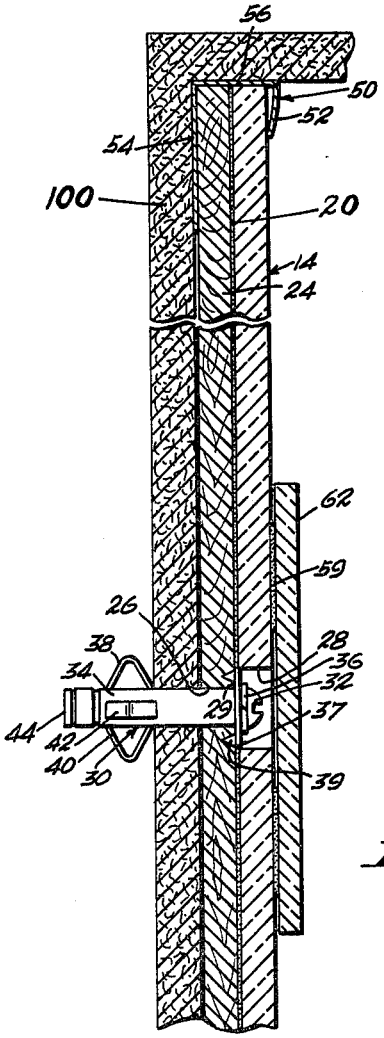
FIG. 2 is a view in cross section taken on the plane indicated by the line 2—2 of FIG. 1 and looking in the direction of the arrows.

Referring to the drawings wherein like reference characters designate like or corresponding parts throughout the several views and referring particularly to FIG. 1, there is shown a wall covering generally designated by the numeral 12 which is composed of three interconnected panels 14, 16 and 18. Each of these panels is composed of the following, referring to FIG. 2, the outer mirror surface designated by the numeral 14, a cement 20 applied to the quick silvered side of the mirror 14 and a backing board 24 which may be of a plywood of suitable thickness. The mirror and the plywood are of companionate size so that the mirror overlays the plywood. Fastener means are provided to secure the panels, composed of the plywood and the mirror cemented to it to a wall 100, which fastener means will now be described. First, a bore or hole 26 is provided at a selected plurality of locations for mounting the mirror to a wall. The bore 26 through the plywood is aligned with a bore 28 through the mirror, which latter bore is slightly larger defining a shoulder 29. A fastener such as that generally designated by the numeral 30 is provided, which is of the type which includes an upsettable sleeve-type stem 34 having an inner end 44 adapted to be received through the bore and legs which are adapted to buckle when the sleeve is drawn tightly together, which is accomplished by a headed end 37 of the sleeve which rests on the shoulder and which may be provided with anti-turned tongs 39 which bite into the surface of the plywood and when the head end 32 is turned against the threaded zone on the interior of the stem, as is conventional, it bears against the washers 36 and the flange on the end of the upsettable stem drawing the legs tightly outwardly defining knees as generally indicated by the portions designated by the numerals 38, 40 and 42 in FIG. 2. Prior to mounting, a frame such as that designated by the numeral 50 may be provided in the form of channel pieces having an inside flange 54, an outside flange 52 and a web 56 sized to receive the marginal edge of the panel composed of the mirror and the backing board. The channel members may be of suitable length and color for highly decorative qualities. Means are provided to close the openings where the fasteners are located and, to this end, decorative outer pieces of mirror are provided, such as that designated by the numeral 62 and positioned over the opening as shown in FIG. 2 and adhered in position as by the adhesive 59 applied to the rear of the covering mirror. In this manner, outer mirrored pieces such as 62, 64, 66 and 68 may be utilized creating a design or suitable impression on the viewer while serving the more important function of covering the fasteners previously described and designated by the numeral 30 on reference to FIG. 2 and shown in FIG. 1, of which 31, 33, and 35 designate corresponding parts being for a member so as to hold the panel 14 in position. Similarly the panel 16 is held in position by screws such as 41, 43 and 47. It will be noted that the covering piece of mirror 64 may, in the design shown, extend across the several mirror panels and cover the holes 31, 47 and 71, the latter two representing the top two fasteners of the mirror 16 which together with the lower two fasteners 41 and 43 are secured in position. Finally, the lower mirror strip 91 in FIG. 1 which covers the fasteners 35, 41 and 43 may also be of a length to extend across and cover the fastener 45 on the right side panel 18. It is thus seen that a variety of decorative mirror designs may be created, some of which include portions such as the portion 93 which serves no structural purpose but creates this overall illusion or design feature matching with the diagonally opposite piece of mirror 95 or, indeed, the mirror pieces on the outside may serve no function other than being highly decorative such as that designated by the numeral 97 which, together with the other pieces form a design on the exterior of the mirror 16. Numerous fasteners may be used in this manner and decorative designs created.

It is thus seen that there has been provided a mirrored wall covering which is portable so that apartment owners may take the same with them when they move. This is because many people have apartments and wish to put mirrors on the wall covering an entire wall to make the little apartment room look bigger. When they move from one apartment to the next apartment there is a problem of getting a mirror which covers the whole wall out of one apartment and into the new apartment. The present invention is of a portable wall covering composed of mirror sections which are interconnected together to cover the entire wall and which can be removed when the person moves to another apartment.

Basically the wall covering of the mirror looks like a regular mirror wall with the difference that it has an artistic design on its surface which disguises the mechanical attachment of the panels to the actual wall of the structure. In a preferred embodiment the mirror is one-quarter inch thick glass while the mirror pieces are one-eighth inch to one-quarter inch in thickness. Preferably, the backing board is of plywood and is one-quarter inch thick covering the total back of the mirror surface. The frame may be a molding of aluminum. As is well known, the background of the mirror may be clear or a bronze mirror and the design may be of a contrasting color to that of the background. For purposes of installation, the mirror is cut to the desired dimension and polished. Two or more panels are positioned adjacent one another in abutting relation forming the seam. In the preferred embodiment, the plywood is foreshortened very slightly with respect to the mirror in the sense that it is about one-eighth of an inch less than the periphery of the mirror on all sides. The holes which are drilled through the mirror are about one-half inch in diameter and in the preferred embodiment the holes at the top of the mirror panels are not further than ten inches from the top edge and eight inches from the sides. In the preferred embodiment, the holes are spaced between ten and fourteen inches from one another. The glue used to mount the mirror to the plywood is a white silicone glue of commercial grade which is applied abundantly on the plywood beginning about two inches from the top and two inches from the side and bottom. The glue should be given at least six hours to dry.

The panels are transported to a job site and there installed whereupon the same may be removed at the option of the user and reinstalled at the different location.

What is claimed is:

1. In combination, a mirrored wall covering comprising:

a plurality of mirrored panels to be mounted in side-by-side abutting relation to cover a wall and wall fastener means to fasten the wall panels to a wall, said mirror panels each comprising a plurality of planar mirrors of predetermined size and shape and each having a main reflective surface and an opposite surface coated with reflective material, a backing board for each mirror panel, said backing board having a first and a second opposite main face and each board being congruent with respect to its associated mirror panel and each of said backing board comprising a rigid load-bearing member, and a coating of adhesive on the opposite mirror surface of each mirror connecting it to the first main surface of its associated backing board, said panels each being sized and configured relative to one another to cover a wall section, and each said panel having a plurality of spaced fastener recesses, each recess being defined by a first bore through the backing board and a second bore aligned with said first bore and of a greater diameter than said first bore and through said mirror and defining a shoulder at said backing board, and said second bore having a mouth at the reflective surface of said mirror and a fastener in each of the bores and each fastener being of a length greater than that of the first bore and having a headed end in the second bore and a plurality of mirror pieces having a first zone sized to cover the mouth of one of the second bores of the wall section and a second zone sized to cover the mouth of an adjacent second bore of the wall section and an intermediate zone connecting said first and second zones, and cement means to adhere the mirror pieces to the wall section.

2. The device as set forth in claim 1 wherein said backing board is of plywood material.

3. The device as set forth in claim 1 wherein frame means are provided for interconnecting the plurality of planar mirrors.

4. The device as set forth in claim 1 wherein said fastener means comprises a sleeve having a first end and a second end, said second end having a radially outturned flange and axially extending teeth on the flange extending toward said second end and adapted to bite into the shoulder of the backing board material and a headed screw in the second bore and extending depthwise toward the second end of the sleeve and adapted to be turned to cause the sleeve to be axially contracted and to buckle to fasten the panels to an existing wall structure.

* * * * *